United States Patent [19]

Kämmerling et al.

[11] Patent Number: 4,828,228

[45] Date of Patent: May 9, 1989

[54] APPARATUS FOR CHANGING THE LEVEL OF TAP RUNNER OF A SHAFT FURNACE

[75] Inventors: Bruno Kämmerling, Dinslaken; Werner Rosker, Oberhausen; Eckhard-Karl Scholz, Bottrop; Wolfgang Kowalski, Dinslaken, all of Fed. Rep. of Germany

[73] Assignee: Man Gutehoffnungshuette GmbH, Fed. Rep. of Germany

[21] Appl. No.: 157,410

[22] Filed: Feb. 18, 1988

[30] Foreign Application Priority Data

Feb. 18, 1987 [DE] Fed. Rep. of Germany ..... 3705099

[51] Int. Cl.[4] ..... C21B 7/14

[52] U.S. Cl. ..... 266/142; 266/196

[58] Field of Search ..... 266/142, 196, 197, 287, 266/236

[56] References Cited

U.S. PATENT DOCUMENTS 1,018,217 2/1912 Szathmary ..... 266/196

1,535,731 4/1925 McKune ..... 266/196

FOREIGN PATENT DOCUMENTS 3624266 1/1988 Fed. Rep. of Germany .

OTHER PUBLICATIONS

VSL International "*Heavy Rigging*" 12/85 pp. 1–6.

*Primary Examiner*—Scott Kastler

*Attorney, Agent, or Firm*—McGlew & Tuttle

[57] ABSTRACT

A device for changing tap runners in shaft furnaces includes tap runners which have linings subject to wear and therefore such runners must be repaired regularly. Transport of the runner requires a considerable crane capacity with correspondingly heavy building construction. The device according to the invention permits transport of the tap runner without a casting room crane. Instead, the tap runner is raised or lowered between the mill floor, or another level, and a tapping platform by means of hydraulically driven traction elements taking support on runner supports arranged at tapping platform level.

2 Claims, 4 Drawing Sheets

APPARATUS FOR CHANGING THE LEVEL OF TAP RUNNER OF A SHAFT FURNACE

FIELD AND BACKGROUND OF THE INVENTION

The invention relates in general to metallurgical furnaces and in particular to a new and useful device for changing tap runners on shaft furnaces.

The tapping of pig iron and slag from a blast furnace occurs at periodical intervals. Depending on the quantity of pig iron produced, there are eight to twelve taps in 24 hours. In the tapping process, the pig iron and slag are separated in a "main tap runner". In recent times such main tap runners on large blast furnaces are given large cross sections. The main tap runner is followed as a rule by additional tap runners and tilting runners for pig iron (to the site of transfer to ladles or "torpedo cars") and slag. While the slag is being discharged from the main tap runner, the pig iron remains in this runner between taps.

With pig iron tap quantities of several thousands of tons daily, the refractory lining of the main tap runner is subject to considerable mechanical and thermal load and consequently to high wear. For this reason it is necessary to repair or completely renew the lining of the runner at regular intervals. The durability of tap runners before the next repair is for example, about 50,000 tons of pig iron; complete renewal occurs after a production of about 120,000 to 130,000 tons of pig iron.

In the case of blast furnaces with more than one tap hole, work on the runner is carried out on the spot in the casting house. During this repair period, the pig iron is tapped from another tap hole, and usually also in a second casting house, so that as a rule this results in either no restrictions, or only minor restrictions of the operation.

The situation is entirely different, however, with blast furnaces which have only one tap hole. Such blast furnaces must be run throttled for the duration of the repair or renewal of the refractory runner lining or, if the work takes more time, the blast furnaces must be shut down.

This fact has suggested the idea to change the main tap runner with the aid of the casting house crane. Or, in the case of main tap runners composed of several sections, the procedure was to change individual sections in need of renewal in the described manner.

Because of the previously mentioned large dimension of the main tap runner, a considerable crane capacity is needed for runner replacement, and, of course, the casting house steel structure must be correspondingly strong. Besides, large areas are needed in the casting house where the removed runner sections can be stored for repair and relining.

Known also is a device for changing the main tap runner of a blast furnace (German patent application No. P 36 24 266.7) in which there are arranged before the tap hole of the blast furnace, on the mill floor, at least four hoisting elements in a stationary or non-stationary manner. These elements engage at cross-heads on which the main tap runner rests. It is possible to lower the runner to be replaced onto transport means located on the mill floor, in particular a track-bound one, and to raise the newly lined runner from the transport means to the level of the casting platform. The main tap runner with the cross-heads is held by means of pneumatically actuated holding arms arranged at the steel structure of the casting platform.

Although with this known device quick changing of the tap runner becomes possible, its installation requires preparatory work, such as earthwork for the retractable hoisting elements.

SUMMARY OF THE INVENTION

The invention provides a changing device for tap runners in shaft furnaces, for the installation of which costly earth and foundation work can be dispersed with, and which can be set up also retroactively in existing metallurgical plants. In addition, such a device is so designed that it is transportable so that in a metallurgical plant with several furnaces it suffices to procure only one device for the changing of tap runners, the more so as the utilization times of the changing devices can readily be coordinated.

Tap runners in shaft furnaces have a high dead weight, for example more than 100 tons including the refractory lining. The required hoisting height from the mill floor to the tapping platform is more than 4 meters. The lifting and lowering of the tap runner for purposes of repair sets considerable requirements for the traction means.

As compared with the state of the art, the changing device according to the invention presents a number of advantages:

As compared with the use of prior art pressure elements for the lifting and lowering, where there is a potential danger of buckling or jack-knifing, the traction elements according to the invention ensures an absolutely secure position of the tap runner during the entire movement sequence;

for equal payload the traction elements are lighter and cheaper than pressure elements;

there is no need for additional guiding tracks, which are necessary for pressure elements;

no expenses for costly earthwork, foundations and drainage;

compared with the weight of the tap runner, the traction elements weigh so little that no appreciable reinforcements of the supports at the tapping platform are necessary;

because of its low weight, the changing device can be used as transportable equipment for several shaft furnaces;

the repaired tap runner need not stand exactly under the site of installation before being fixed to the traction elements, so that faster installation becomes possible;

as the traction elements are located above the load, they are accessible without danger in case of any malfunction thereof during a hoisting process.

Accordingly it is an object of the invention to provide a device for moving and changing the level of a tap runner which is used with shaft furnaces between a first level including a mill floor or another level and a second level including a tapping level which comprises a plurality of vertically extending supports positioned between the first and second levels in a corresponding number of runner supports affixed to the second level and with holding means for mounting or connecting the tap runners to the supports so that they may be raised and lowered on the supports and which also includes a drive mechanism which is connected to the holding means and the supports for raising and lowering the tap runners.

A further object of the invention is to provide a device for changing the level of tap runners which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 5:
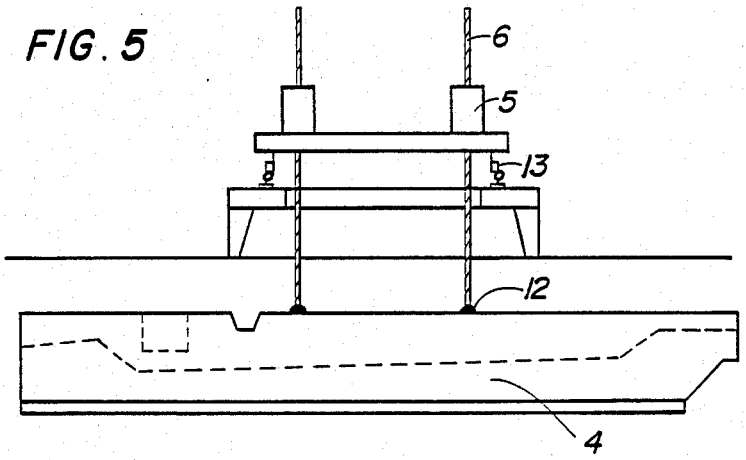
FIG. 5 is a view similar to FIG. 3 of another embodiment of the invention.

Referring to the drawings in particular, the invention embodied therein comprises a device for changing a level of a tap runner 4 which is used with a shaft furnace between a first level including a mill floor 2 or another level and a second level including a tapping level at the location of a tapping platform 3. In accordance with the invention a plurality of vertically extending supports or rods positioned or mounted between the first and second levels and they are advantageously guided in runner supports or guideways 7,7 which are mounted at the tapping platform level 3. The arrangement includes means for holding or guiding the tap runner 4 for its movement up and down on the rods 6 and in the embodiment of FIGS. 1 and 2, which comprises the cross-heads 10 which are secured to the lower ends of the rods 6. Alternatively, for example, the rod 6 may be connected directly to the runners such as by shackles 12 as indicated in FIG. 5.

Figure 1:
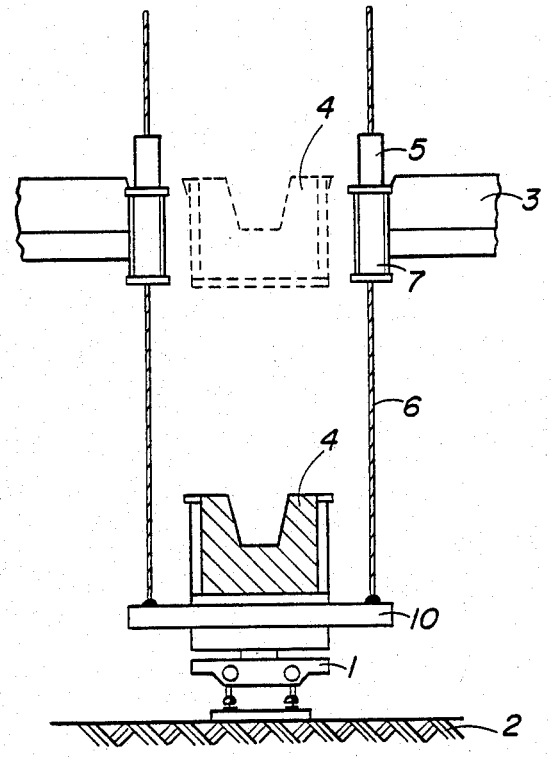
FIG. 1 is a section through a tapping platform and mill floor with the changing device according to the invention.
Figure 2:
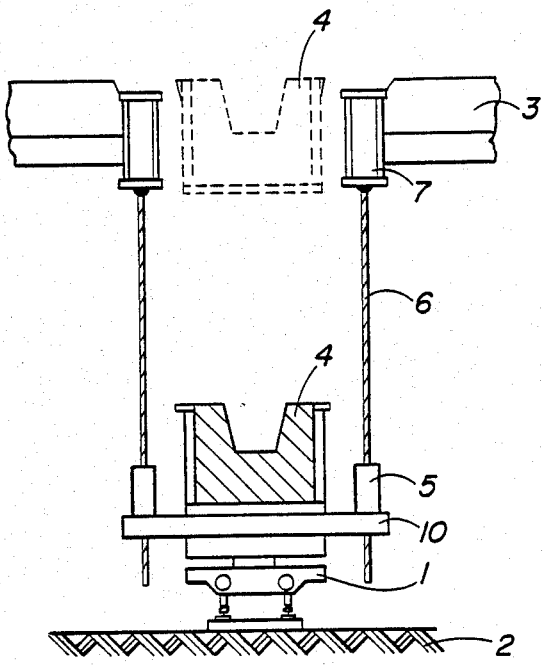
FIG. 2 is a view similar to FIG. 1 of another embodiment of the invention.

The arrangement of the invention includes drive elements or traction elements 5,5 which as shown in FIG. 1 are located at the platform level 3 or as shown in FIG. 2 on a cross-head 10 which supports the top runner 4.

In FIGS. 1 and 2, the tap runner 4 is located on the transport means 1 wheelable on the mill floor 2. Between the tap runner and transport means platform one sees cross-heads 10, which are arranged under the tap runner 4. Fitted to the cross-heads 10 are cords or climbing rods 6 of the traction elements 5.

The traction elements 5 are arranged on supports 7 welded to the tapping platform 3 of the shaft furnace. The traction elements 5 are supplied by a hydraulic pump unit (not shown).

As distinguished from FIG. 1, FIG. 2 shows traction elements 5 which are arranged at the cross-heads 10 of the tap runner 4. Here the device operates in the reverse manner, i.e. the traction elements 5 pull themselves up or lower themselves with the tap runner 4 on the cross-head 10 to the tapping platform 3.

A known cord or rod conveyance system, where loads are moved with the aid of electrohydraulically driven lifters ("siphons", jacks), is suitable for the changing device according to the invention.

Instead of such a conveyance system, mechanically operable spindle traction elements (not shown) may be used.

Figure 4:
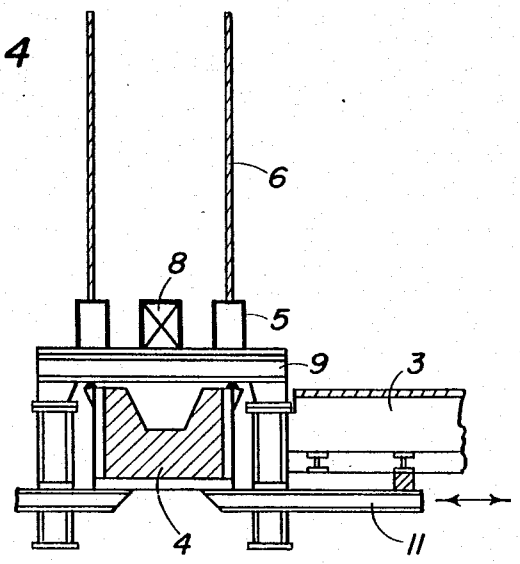
FIG. 4 is a section transverse to the section of FIG. 3.
Figure 3:
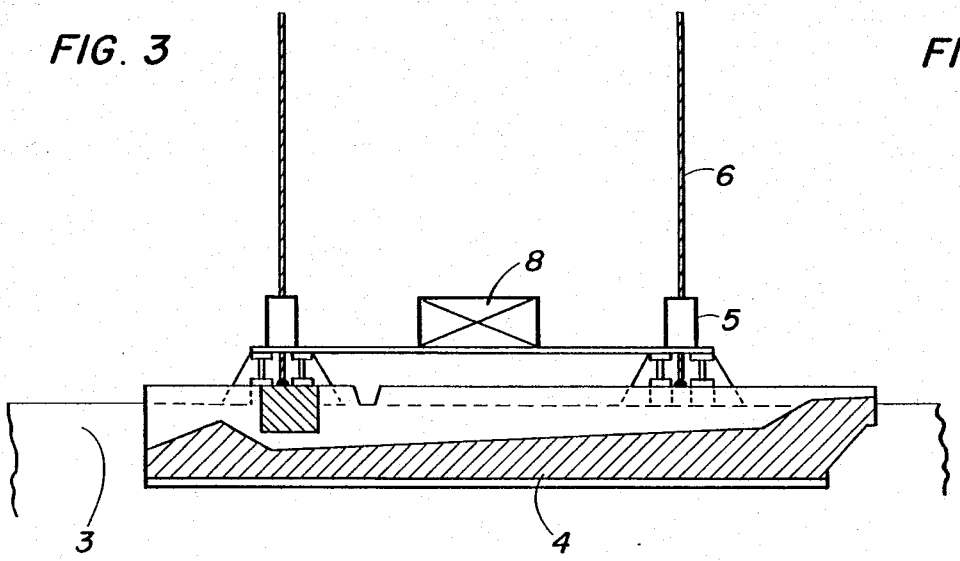
FIG. 3 is a longitudinal section with the tap runner raised.

FIGS. 3 and 4 show an embodiment example where the traction elements 5 and the hydraulic pump unit 8 are arranged on a transportable platform 9. Hydraulic hoses 20 and 22 are provided for connecting the pump unit 8 to the traction elements 5,5. The platform 9 may be in one part or multi-part, its feet standing on the runner supports 7 of the tapping platform 3. By a shackle connection 12 the tap runner 4 is detachably fastened to the rods or cords 6 of the traction elements 5.

As soon as the tap runner 4 has been raised to the level of the tapping platform 3, the runner 4 is supported with the aid of supports 11 to be pulled forward and back, disposed laterally below the tapping platform. The supports 11 are therewith pushed through corresponding openings **7*a* in the runner supports 7. As soon as the runner 4 is firmly seated on the supports 11 and the shackle connection 12 has been released, the platform 9 with the traction elements 5** can be removed by a crane.

As an alternative (not shown), the hydraulic pump unit 8 can, of course, be set up for example laterally on the tapping platform 3, in which case there must be hose connections to the traction elements 5.

FIG. 5 shows a tap runner 4 hanging on rods or cords 6. Here the traction elements 5 are mounted on the platform of a turntable 13, which runs on tracks present on the platform 9. The turntable 13 can be moved 360° in the horizontal plane.

Figure 6:
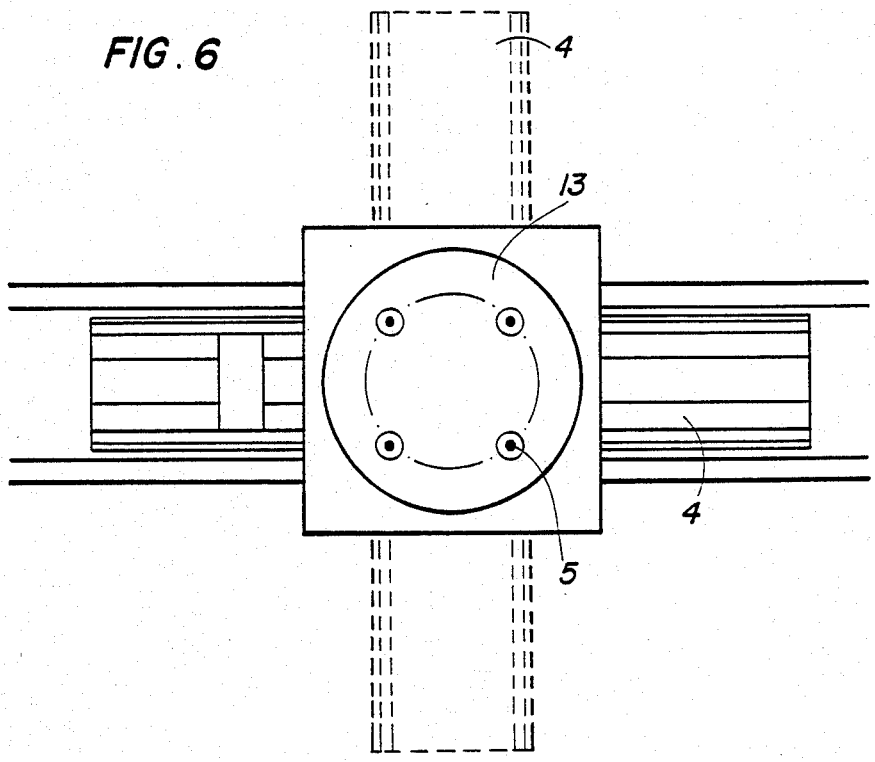
FIG. 6 is a top plan view of the device shown in FIG. 5.

FIG. 6 is to show that with the aid of the turntable 13 it is possible to bring the runner 4 hanging from the traction elements 5, as distinguished from the position assumed on the tapping platform 3, into another angular position during lowering. According to FIG. 5, the tracks for the transport means are arranged on the mill floor e.g. at right angles to the position of the runner from the tapping platform.

While specific embodiments of the invention have been shown and described in detail to illustrate the application of the principles of the invention, it will be understood that the invention may be embodied otherwise without departing from such principles.

What is claimed is:

1. A device for moving a tap runner used with a shaft furnace vertically between a first low level including at least one of a mill floor level and another low level and a second, high tapping platform level, comprising a plurality of vertically extending supports positioned for extension between said first and second levels, a plurality of support guides affixed to said second level providing guiding elements for said supports, holding means for associating said tap runner to said supports for raising and lowering said tap runner on said supports, a drive mechanism connected to said holding means and said support for raising and lowering said tap runner on said supports and a turntable having rotatable and non-rotatable part, said non-rotatable part being engaged on said support guides and said rotatable part carrying the runner.

2. A device according to claim 1, wherein said drive mechanism is carried on said turntable.

* * * * *